US009315888B2

(12) United States Patent
Baldwin et al.

(10) Patent No.: US 9,315,888 B2
(45) Date of Patent: Apr. 19, 2016

(54) NOZZLE INSERT FOR THERMAL SPRAY GUN APPARATUS

(71) Applicant: General Electric Company, Schenectady, NY (US)

(72) Inventors: Donald Joseph Baldwin, Galway, NY (US); Joseph Garfield Albanese, Rotterdam Jct., NY (US); Joshua Lee Margolies, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 198 days.

(21) Appl. No.: 14/093,608

(22) Filed: Dec. 2, 2013

(65) Prior Publication Data

US 2015/0152541 A1 Jun. 4, 2015

(51) Int. Cl.

| | |
|---|---|
| ***B05B 1/24*** | (2006.01) |
| ***B05B 7/02*** | (2006.01) |
| ***C23C 4/12*** | (2006.01) |
| ***B05B 7/22*** | (2006.01) |
| ***B05B 13/04*** | (2006.01) |
| ***H05H 1/34*** | (2006.01) |
| ***H05H 1/42*** | (2006.01) |

(52) U.S. Cl.

CPC ..... *C23C 4/127* (2013.01); *B05B 7/226* (2013.01); *B05B 13/0431* (2013.01); *H05H 1/34* (2013.01); *H05H 1/42* (2013.01); *H05H 2001/3457* (2013.01); *H05H 2001/3473* (2013.01); *H05H 2001/3484* (2013.01)

(58) Field of Classification Search

CPC ..... B05B 1/24; B05B 5/025; B05B 5/0426; B05B 5/0427; E01H 13/00

USPC ..... 239/128, 133, 134, 692, 706, 526

See application file for complete search history.

(56) References Cited

U.S. PATENT DOCUMENTS

| | | | | |
|---|---|---|---|---|
| 3,637,420 | A * | 1/1972 | Walberg | B05B 5/03 427/479 |
| 3,740,522 | A | 6/1973 | Muehlberger | |
| 3,914,573 | A | 10/1975 | Muehlberger | |
| 4,416,421 | A | 11/1983 | Browning | |
| 4,445,021 | A | 4/1984 | Irons et al. | |

(Continued)

FOREIGN PATENT DOCUMENTS

WO 2013112178 A1 8/2013

OTHER PUBLICATIONS

Molz et al., "Better Performance of Plasma Thermal Spray", Advanced Materials and Processes, Aug. 2006, pp. 65-67.

(Continued)

*Primary Examiner* — Davis Hwu

(74) *Attorney, Agent, or Firm* — Ernest G. Cusick; Hoffman Warnick LLC

(57) ABSTRACT

Various aspects of the present disclosure relate to a nozzle insert which may be used with a thermal spray gun apparatus. A nozzle insert according to the disclosure may include a body having an outer surface, the outer surface of the body being configured to circumferentially contact and transfer heat to an inner face of a thermal spray gun nozzle of a thermal spray gun. The body of the nozzle insert may be removed from the thermal spray gun nozzle without disassembling the thermal spray gun, and includes an axial passage configured to communicate a plasma discharge from the nozzle insert. A thermal spray gun apparatus and a thermal spray gun system including the nozzle insert are also disclosed.

13 Claims, 7 Drawing Sheets

(56) References Cited

U.S. PATENT DOCUMENTS

| | | | | |
|---|---|---|---|---|
| 4,649,257 | A | | 3/1987 | Yakovlevitch et al. |
| 4,780,591 | A | | 10/1988 | Bernecki et al. |
| 4,788,402 | A | | 11/1988 | Browning |
| 4,841,114 | A | | 6/1989 | Browning |
| 4,916,273 | A | | 4/1990 | Browning |
| 4,924,059 | A | | 5/1990 | Rotolico et al. |
| 5,008,511 | A | | 4/1991 | Ross |
| 5,040,732 | A | * | 8/1991 | Anderson ..... B05B 5/001 239/124 |
| 5,225,652 | A | | 7/1993 | Landes |
| 5,298,835 | A | | 3/1994 | Muehlberger et al. |
| 5,332,885 | A | | 7/1994 | Landes |
| 5,406,046 | A | | 4/1995 | Landes |
| 5,444,209 | A | | 8/1995 | Crawmer et al. |
| 5,452,854 | A | | 9/1995 | Keller |
| 5,556,558 | A | | 9/1996 | Ross et al. |
| 6,068,201 | A | | 5/2000 | Hawley et al. |
| 6,114,649 | A | | 9/2000 | Delcea |
| 6,202,939 | B1 | | 3/2001 | Delcea |
| 6,392,189 | B1 | | 5/2002 | Delcea |
| 6,559,407 | B2 | | 5/2003 | Chancey et al. |
| 7,375,301 | B1 | | 5/2008 | Noujaim |
| 7,578,451 | B2 | | 8/2009 | Mueller |
| 7,750,265 | B2 | | 7/2010 | Belashchenko |
| 7,759,599 | B2 | | 7/2010 | Hawley et al. |
| 7,959,983 | B1 | | 6/2011 | Farrar et al. |
| 8,030,592 | B2 | | 10/2011 | Weidman |
| 2005/0077272 | A1 | | 4/2005 | Fusaro et al. |
| 2006/0108332 | A1 | | 5/2006 | Belashchenko |
| 2008/0121624 | A1 | | 5/2008 | Belashchenko et al. |
| 2008/0251503 | A1 | | 10/2008 | Noujaim |

OTHER PUBLICATIONS

U.S. Appl. No. 12/551,661, Notice of Allowance and Fees Due dated Jun. 26, 2012, 238552-1, 12 pages.

European Search Report and Opinion issued in connection with corresponding EP Application No. 14194454.6 on Apr. 23, 2015.

European Application No. 14194454, European Search Report and Opinion, Dated Apr. 23, 2015, 5 Pages.

* cited by examiner

300

| Plasma Gas Flow (SCFH) | Power Output (kW), Non-divergent Nozzle | |
|---|---|---|
| - | With Insert | No Insert |
| 108 | 60.5 | 64.5 |
| 118 | 66 | 69 |
| 128 | 69 | 71.5 |
| 138 | 73.5 | 75 |
| 148 | 76 | 79 |

FIG. 6

302

| Plasma Gas Flow (SCFH) | Power Output (kW), Divergent Nozzle | |
|---|---|---|
| - | With Insert | No Insert |
| 108 | 60 | 62.5 |
| 118 | 64.5 | 67.5 |
| 128 | 67.5 | 71.5 |
| 138 | 71.5 | 77.5 |
| 148 | 75 | 79.5 |

FIG. 7

NOZZLE INSERT FOR THERMAL SPRAY GUN APPARATUS

CROSS-REFERENCE TO RELATED APPLICATIONS

This application is related to the disclosure of U.S. patent application Ser. No. 12/551,661, filed on Sep. 9, 2009, now U.S. Pat. No. 8,237,079.

BACKGROUND OF THE INVENTION

Embodiments of the present disclosure relate generally to a thermal spray gun. Specifically, the subject matter disclosed herein relates to a nozzle insert which may be used with a thermal spray gun apparatus.

Thermal spraying is a coating method wherein powder or other feedstock material is fed into a stream of heated gas produced by a plasmatron or by the combustion of fuel gasses. The hot gas stream entrains the feedstock, transferring heat and momentum thereto. The heated feedstock becomes a discharge that is further impacted onto a surface, where it adheres and solidifies, forming a thermally sprayed coating composed of thin layers or lamellae.

One common method of thermal spraying is plasma spraying. Plasma spraying is typically performed by a plasma torch or "spray gun," which uses a plasma jet to heat or melt the feedstock before propelling it toward a desired surface. Current thermal spray guns operate efficiently (e.g., over 60% efficiency) at one power mode (e.g., 75 kW) and deliver one coat in one position with respect to a specimen. When spraying different coats and/or different specimens, extensive modifications to the spray gun may be necessary to adjust the discharge.

Spraying different specimens, or different portions of the same specimen, may require using different thermal spray guns with different power levels to generate varying plasma plumes and coatings. In order to spray a different type of coating, the thermal spray gun may be removed from the robotic arm and disassembled to install a replacement nozzle, after which the thermal spray gun can be reassembled. The assembly and reassembly process typically require a reservoir of cooling water to be opened, drained, and then refilled. Each thermal spray gun nozzle may be configured to emit a different plasma discharge. Physical properties of a plasma spray gun system, such as standoff distance, may change in response to the modified gun being mounted to a robotic arm configured for use with a different thermal spray gun. In this case, the robotic arm may require adjusting (e.g., via reprogramming). This reprogramming step may be inconvenient to the operator and cause delays in the spraying process.

BRIEF DESCRIPTION OF THE INVENTION

At least one embodiment of the present disclosure is described below in reference to its application in connection with thermal spray guns. However, it should be apparent to those skilled in the art and guided by the teachings herein that embodiments of the present invention are applicable to situations other than thermal spray gun technology.

A first aspect of the present disclosure provides a nozzle insert comprising: a body having an outer surface, the outer surface of the body being configured to circumferentially contact and transfer heat to an inner face of a thermal spray gun nozzle of a thermal spray gun; wherein the body is configured to be removed from the thermal spray gun nozzle without disassembling the thermal spray gun, and includes an axial passage configured to communicate a plasma discharge from the nozzle insert.

A second aspect of the present disclosure provides a thermal spray gun comprising: a thermal spray gun body having a thermal spray gun nozzle; and a removable nozzle insert circumferentially contacting an inner face of the thermal spray gun nozzle, the removable nozzle insert having an axial passage; wherein the axial passage of the removable nozzle insert is configured to communicate a plasma discharge from within the thermal spray gun body through the axial passage.

A third aspect of the present disclosure provides a thermal spray gun system comprising: an electrode body housing an electrode; a thermal spray gun body having a fore portion and an aft portion, the thermal spray gun body housing a thermal spray gun nozzle at the fore portion and coupled to the electrode body at the aft portion; and a removable nozzle insert in circumferential contact with an interior face of the thermal spray gun nozzle and configured to transfer heat thereto, the removable nozzle insert including an axial passage configured to communicate a plasma discharge from within the thermal spray gun body; wherein the electrode body is configured to generate an electrical arc between the electrode and the thermal spray gun body, and the electrical arc converts a feedstock into the plasma discharge.

BRIEF DESCRIPTION OF THE DRAWING

These and other features of the disclosed apparatus will be more readily understood from the following detailed description of the various aspects of the apparatus taken in conjunction with the accompanying drawings that depict various embodiments of the invention, in which:

FIG. 6 provides a table of test data illustrating properties of an embodiment of the present disclosure.

FIG. 7 provides another table of test data illustrating properties of an embodiment of the present disclosure.

It is noted that the drawings are not necessarily to scale. The drawings are intended to depict only typical aspects of the disclosure, and therefore should not be considered as limiting its scope. In the drawings, like numbering represents like elements between the drawings.

DETAILED DESCRIPTION OF THE INVENTION

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be used and that changes may be made without departing from the scope of the present teachings. The following description is, therefore, merely exemplary.

When an element or layer is referred to as being "on," "engaged to," "disengaged from," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, aspects of the invention provide for a nozzle insert which may be used in a thermal spray gun apparatus or system. During operation, thermal spray guns are typically mounted on a robotic arm or robotic apparatus. A specimen (e.g., a turbine blade) is typically mounted on a holder at a distance from the thermal spray gun's fore end (exit annulus). This distance is known as the "standoff distance." The standoff distance may be dictated in part by the type of specimen to be sprayed and the type of material or coating to be applied. During operation, plasma spray leaves the gun's exit annulus and is propelled toward the specimen. The manner in which plasma spray leaves the gun's exit may be known as a "plasma discharge." A plasma discharge can have particular values of velocity, temperature, and may have a specific plume shape. Aspects of the present invention provide for an adjustable thermal spray gun that may efficiently adapt to different spray needs (e.g., coatings) without the need to disassemble the thermal spray gun, thus opening the coolant system. Specifically, aspects of the present invention provide for a nozzle insert for a thermal spray gun apparatus.

Figure 1:
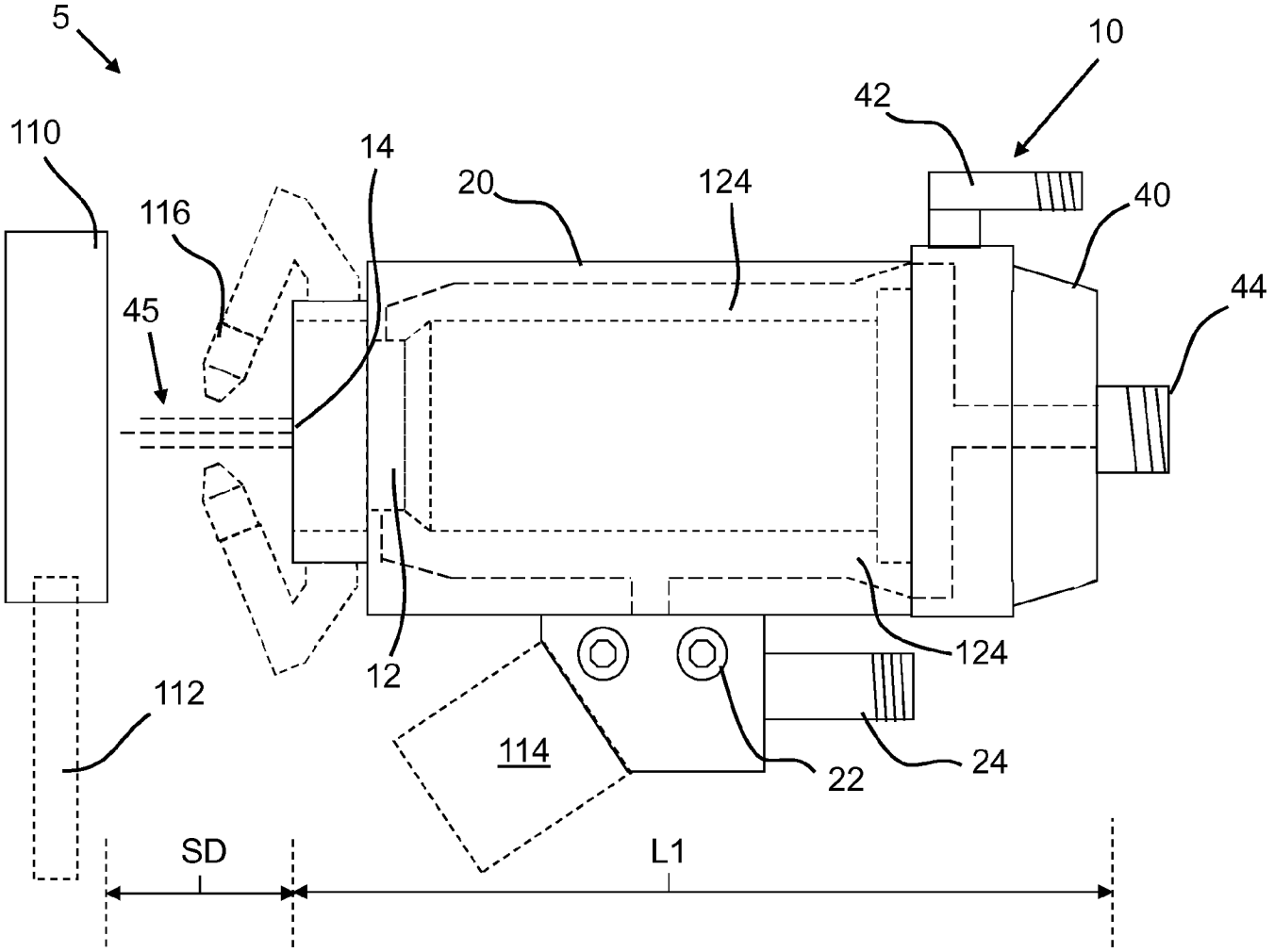
FIG. 1 shows a side view of a thermal spray gun system according to an embodiment of the invention.

Turning to FIG. 1, a thermal spray gun system 5 is shown, including an adjustable thermal spray gun apparatus 10, a specimen 110, a specimen holder 112 (shown in phantom), a robotic arm 114 (shown in phantom) and one or more injector ports 116 (shown in phantom). For the purposes of clarity, a thermal spray gun without a nozzle insert is described herein. Thermal spray gun apparatus 10 may include a thermal spray gun body 20, which may hold a thermal spray gun nozzle 12 (shown in phantom). Thermal spray gun body 20 and thermal spray gun nozzle 12 may share an exit annulus 14, and may be electrically connected to each other by each being composed of a conductive material or otherwise being configured to allow electricity to travel between thermal spray gun body 20 and thermal spray gun nozzle 12. Thermal spray gun body 20 may further include one or more mounts 22 for attaching to robotic arm 114, and a port 24 for receiving and/or expelling coolant from an external source (not shown). Port 24 may additionally be an electrical connection coupled to an external electric power supply (not shown). Thermal spray gun body 20 may be removably attached to an electrode body 40 at one portion. However, thermal spray gun body 20 is electrically insulated from the electrode housed within electrode body 40. Electrode body 40 may include a plasma gas port 42 for receiving input gas from an external source (not shown), and a port 44 for receiving and/or expelling coolant from an external source (not shown). Similar to port 24, port 44 may additionally be an electrical connection coupled to an external electric power supply (not shown). Descriptions of external electric power and gas supplies are omitted herein, and function substantially similarly to those known in the art. Thermal spray gun apparatus 10 may have a length Ll, which may include the distance from approximately the aft end of electrode (farthest end from specimen 110) to exit annulus 14. The distance between exit annulus 14 and specimen 110 is shown as the standoff distance SD. As further described herein and illustrated in the Figures, embodiments of the present disclosure can modify thermal spray gun system 5, e.g., by changing the shape of an emitted plasma plume or discharge.

During operation of thermal spray gun system 5, an electrical arc can form inside electrode body 40 and thermal spray gun body 20, where electrode body 40 acts as a cathode electrode and thermal spray gun body 20 acts as an anode. Plasma gas is fed through plasma gas port 42, and extends the arc to exit annulus 14, where injector ports 116 may supply feedstock material into a plasma jet stream or discharge 45 as it leaves thermal spray gun body 20 and thermal spray gun nozzle 12 via exit annulus 14. Injector ports 116 may allow for radial supply of feedstock into discharge 45. Feedstock may be, for example, a powder entrained in a carrier gas and/or a suspension solution. However, feedstock used in the embodiments described herein may be any feedstock material used in plasma spraying. Discharge 45, including feedstock, is then propelled toward specimen 110, thereby coating it. Standoff distance SD is designed to optimize spraying conditions for a particular specimen 110 or feedstock material.

Figure 2:
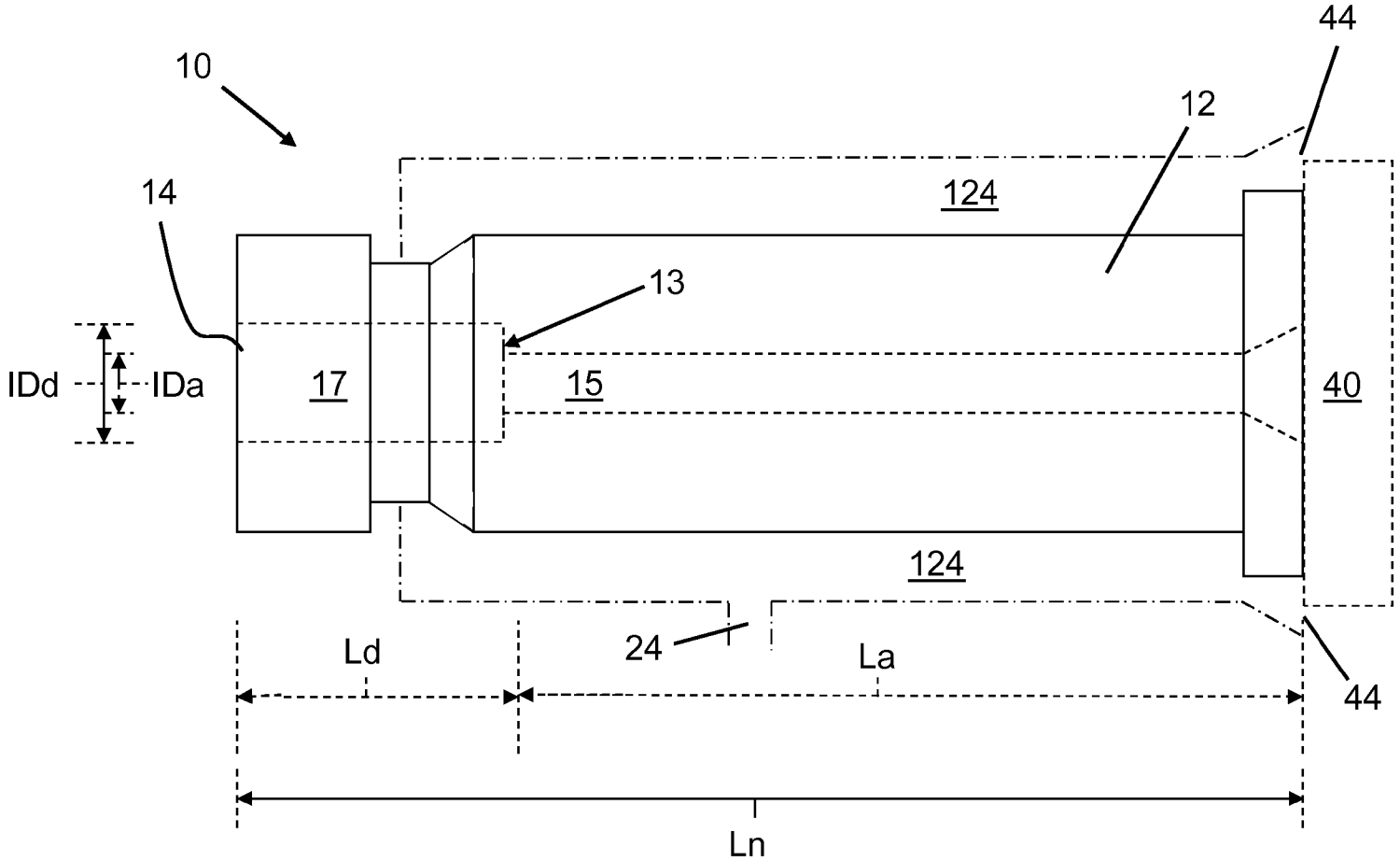
FIG. 2 shows a side view of a thermal spray gun nozzle according to an embodiment of the invention.

The power of a thermal spray gun is driven in part by the length of its plasma "arc" (arc length). The arc length is a component of the total length of thermal spray gun nozzle 12. Turning to FIG. 2, a side view of one embodiment of thermal spray gun nozzle 12 (nozzle), without modifications, and a portion of electrode body 40 are shown. Embodiments of the present disclosure may be used to modify thermal spray gun nozzle as described herein by reference to FIGS. 2-5. Nozzle 12 includes an inner diameter (IDa) of its arc portion 15, and an inner diameter (IDd) of its divergent portion 17. In one embodiment, nozzle 12 may have an IDa of between approximately 0.50 and 1.0 centimeters, and an IDd of between approximately 1.20 centimeters and approximately 1.70 centimeters. Inner diameters of the arc portion (IDa) and divergent portions (IDd) will affect the exit velocity of the plasma gas leaving exit annulus 14, and will affect the velocity of the sprayed materials at impact on specimen 110. In one embodiment, for higher velocity operation, IDa may be between approximately 0.6 centimeters and 0.75 centimeters.

Thermal spray gun body 20 may include a coolant sleeve 124 at least partially surrounding nozzle 12, through which coolant from port 24 or port 44 may travel. As thermal spray gun system 5 operates, nozzle 12 can increase in temperature as plasma gas feedstock is converted to a plasma discharge by electricity from electrode body 40. To prevent material failures associated with the discharge being overheated, coolant sleeve 124 may surround the exterior of nozzle 12. Coolant sleeve 124 may be a passage designed to deliver coolant from one port (e.g., port 24 or port 44) to another. Coolant entering coolant sleeve 124 may absorb heat from the exterior of nozzle 12 and increase in temperature before exiting nozzle 12 through another port.

As shown in FIG. 2, an expanded view of thermal spray gun nozzle 12 of thermal spray gun apparatus 10 is shown. Thermal spray gun nozzle 12 can have a total length (Ln), which includes an arc length (La) and a divergence length (Ld). Some thermal spray guns which can be used in embodiments of the present disclosure may have an insignificant divergence, and thus an accompanying divergence length (Ld) of zero. Arc length (La) is the portion of total length (Ln) over which the plasma arc is formed, and extends between the electrode (within electrode body 40) and an arc root attachment 13. As described with reference to FIG. 1, plasma gas is heated due to the electrical potential difference (or arc voltage) between the electrode (within electrode body 40) and arc root attachment 13. The plasma gas then expands and/or cools over divergent length (Ld) before being released from thermal spray gun apparatus 10 and impacting specimen 110 (FIG. 1). Divergent length (Ld) is chosen in order to prevent the arc root from extending beyond exit annulus 14. The discharge from thermal spray gun apparatus 10 is partially dependent on quantities such as the arc voltage, arc length (La), and overall shape of nozzle 12. As such, in order to discharge a different type of coat, a different nozzle 12 may be required. However, modifying thermal spray gun nozzle 12 in a conventional setting may require disassembling thermal spray gun body 20 (FIG. 1).

Figure 3:
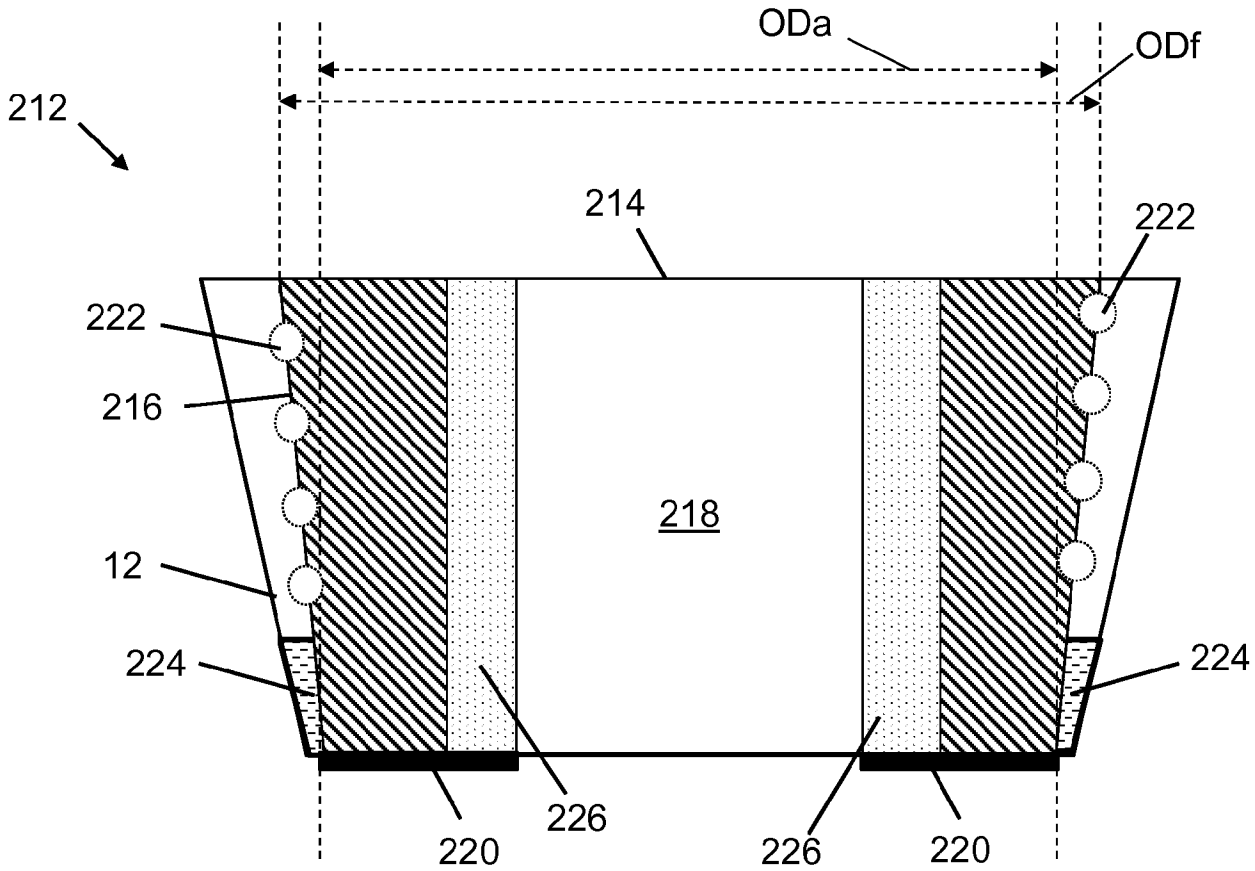
FIG. 3 shows a cross-sectional view of a nozzle insert according to an embodiment of the invention.

Turning to FIG. 3, a nozzle insert according to an embodiment of the present disclosure is shown. To modify the coat and/or plume shape discharged from a thermal spray gun, a nozzle insert 212 with a geometry corresponding to nozzle 12 (shown in phantom) may be inserted therein to create circumferential contact between nozzle 12 and nozzle insert 212. In contrast to conventional systems, nozzle insert 212 can be installed within or removed from a thermal spray gun (e.g., thermal spray gun apparatus 10) by passing through the fore (discharge) end of exit annulus 14 (FIGS. 1, 2). As a result, nozzle insert 212 can be removed and inserted without disassembling or otherwise opening thermal spray gun body 20 (FIG. 1) of thermal spray gun system 5 (FIG. 1). In the embodiment shown by example in FIG. 3, nozzle insert 212 may be removable from nozzle 12 by having an outer diameter at its fore (discharge) end (denoted by line ODf) that is greater than the outer diameter of its aft end (denoted by line ODa).

Nozzle insert 212 may include a body with an exit region 214 and an outer surface 216. Outer surface 216 may have a profile similar to nozzle 12, in order to engage and circumferentially contact an inner face of nozzle 12. In some embodiments, nozzle insert 212 may directly engage the inner face of nozzle 12, while additional structures may be interposed between nozzle insert 212 and nozzle 12 in other embodiments. In any event, contact between nozzle 12 and nozzle insert 212 can allow heat to be transferred from nozzle insert 212 to nozzle 12. Thermal contact between 212 and nozzle 12 allows a single cooling medium (e.g., coolant in coolant sleeve 124, FIGS. 1, 2) to absorb heat from nozzle 12. In turn, nozzle 12 can absorb heat from nozzle insert 212. To increase the transfer of heat from nozzle insert 212 to nozzle 12, nozzle insert 212 and/or nozzle 12 may be composed of the same material or a similar material (i.e., a common metal), such as copper, tungsten, silver, etc. Removing accumulated heat from nozzle insert 212 allows nozzle insert 212 and nozzle 12 to resist material defects such as inadvertent bonding, thermal pinching, and other types of heat-related damage.

To communicate discharges from thermal spray gun body 20 (FIG. 1) through nozzle insert 212, an axial passage 218 may extend through nozzle insert 212. Axial passage 218 may run from the fore (discharge) end of nozzle insert 212 to its aft end. A discharge from plasma spray gun body 20 (FIG. 1) of plasma spray gun apparatus 10 (FIGS. 1, 2) may enter nozzle 12, travel through axial passage 218, and exit through both exit region 214 and exit annulus 14 (FIG. 2). Axial passage 218 may be shaped to change one or more properties of a discharge passing therethrough. For example, the dimensions of axial passage 218 may create a particular velocity, temperature, or plume shape of the discharge from thermal spray gun body 20 (FIG. 1). The discharge through axial passage 218 may be different from the discharge from nozzle 12 without nozzle insert 212 being included therein. Thus, the presence or absence of nozzle insert 212 can customize the discharge from a thermal spray gun apparatus and/or system.

If desired, the aft end of nozzle insert 212 can be coated or plated with an electrically insulative material 220. As discussed elsewhere herein, discharge from thermal spray gun apparatus 10 (FIGS. 1, 2) is created by electrical arcs generated between electrode body 40 (FIGS. 1, 2) and thermal spray gun body 20 (FIG. 1). To prevent electrical arcs from reaching nozzle insert 212 instead of thermal spray gun body 20 (FIG. 1), electrically insulative material 220 can reduce the opportunity for electrical arcs to reach the various components of nozzle insert 212. Thus, electrically insulative material 220 can reduce malfunctions associated with electrical arcs from electrode body 40 (FIG. 1) not reaching thermal spray gun body 20 (FIG. 1). In some embodiments, the entirety of nozzle insert 212 or a portion thereof can be composed of an electrically insulative material to effectively prevent electrical arcs from reaching nozzle insert 212. Any material or group of materials commonly used for electrical insulation may be used for electrically insulative material 220, and may include, e.g., a dielectric such as silicon oxide ($SiO_2$), silicon nitride ($Si_3N_4$), etc.

Circumferential contact between nozzle 12 and nozzle insert 212 can be aided with additional components or mechanisms. For example, nozzle insert 212 can be equipped with one or more fasteners 222 (shown in phantom) designed to couple nozzle insert 212 with nozzle 12. In an embodiment, fasteners 222 may be in the form of threads designed to interlock with corresponding ridges (not shown) located on outer surface 216. Fasteners 222 may obstruct motion by nozzle insert 212 along the direction of axial passage 218 by their placement between nozzle insert 212 and nozzle 12. Fasteners 222 can contact nozzle 12 to hold nozzle insert 212 in place when coupled thereto. Fasteners 222 can also be configured to engage or disengage nozzle 12, e.g., by being screwed into or unscrewed from nozzle 12, allowing nozzle 212 to be added or removed as needed. In addition to the threads of fastener 222 shown by example in FIG. 3, other currently known or later developed forms of mechanical connection can secure nozzle insert 212 to nozzle 12. For example, fasteners 222 may include latches, locks, adhesive surfaces, and other similar devices.

To provide additional thermal contact between nozzle insert 212 and nozzle 12, a seal element 224 may be attached or coupled to outer surface 216 of nozzle insert 212. Seal element 224, which may be in the form of a flange, seal washer, or other sealing component currently known or later developed, stops discharge from circumventing nozzle insert 212 by acting as a continuous blocking surface. The material composition of seal element 224 can include thermally conductive metals such as nickel, copper, silver, and/or indium. Seal element 224, by being coupled to outer surface 216 of nozzle insert 212, can prevent any discharge from flowing between nozzle 12 and nozzle insert 212 to alter or undercut the effects of axial passage 218. In addition, seal element 224 can be composed of a thermally conductive material, thereby allowing the transfer of accumulated heat from nozzle insert 212 to nozzle 12, which in turn is cooled by a cooling medium in coolant sleeve 212.

In an embodiment, the properties of a discharge from thermal spray gun apparatus 10 (FIGS. 1, 2) can be adjusted by using a "nozzle set" composed of several nozzle inserts 212.

Each axial passage 218 in a "nozzle set" can have a specific corresponding set of dimensions and shapes configured to adjust the velocity, temperature, and plume shape of the discharge. For example, the inner diameter of the discharge end of each nozzle insert 212 can vary to create a divergent axial passage 218. In addition, the interior of nozzle insert 212 can be modified, as shown elsewhere herein with respect to FIG. 5, to create a complex or composite geometry of axial passage 218. Thus, several nozzle inserts 212, each configured to communicate a different plasma discharge, can be placed within nozzle 12. A user of a thermal spray gun system 5 (FIG. 1) can install or remove each nozzle insert 212 in the set, as needed, without disassembling thermal spray gun body 20 (FIG. 1). Nozzle insert 212 (or several nozzle inserts 212 if part of a set) can discharge a particular type of coat from thermal spray gun apparatus 10 (FIGS. 1, 2). For example, one nozzle insert 212 may discharge a bondcoat, a thermal barrier coat (TBC), an abradable coat, an environmental barrier coat (EBC), or any individual layer of the coats described herein. For example, an environmental barrier coat (EBC) (an example of which is described in detail in U.S. Pat. No. 8,273,470) is composed of several individually applied layers. In an embodiment of the present disclosure, thermal spray gun apparatus 10 (FIGS. 1, 2) can discharge one of the several layers of an EBC, while some or all of the remaining layers can be discharged by using other nozzle inserts 212 with thermal spray gun apparatus 10 (FIGS. 1, 2).

In an embodiment, axial passage 218 of nozzle insert 212 can be coated with a liner material 226. Liner material 226 can be provided to increase the thermal resistance of nozzle insert 212, including axial passage 218, to various environmental factors such as increased heat. Liner material 226 maybe composed at least partially of, for example, silicon nitride ($Si_3N_4$), a refractory metal such as tungsten (W), a ceramic material, or other materials having a higher melting point than the material composition of nozzle insert 212. In a specific example, nozzle inserts 212 composed of copper can be lined with any material with a higher melting point than copper.

Figure 4:
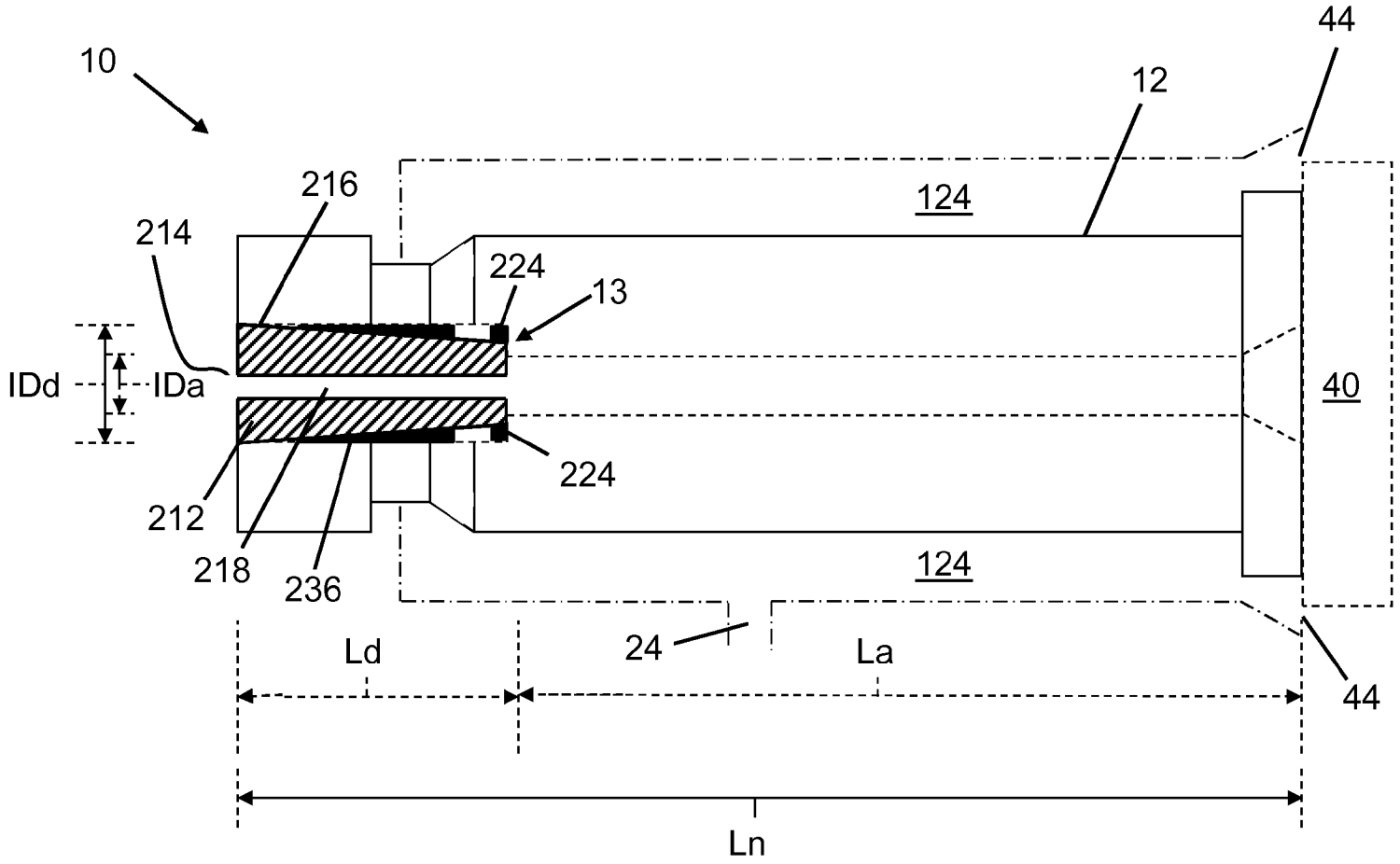
FIG. 4 shows a side view of a thermal spray gun with a removable nozzle insert according to an embodiment of the invention.

As shown in FIG. 4, a thermal spray gun apparatus 10 can feature an embodiment of nozzle insert 212 located within nozzle 12. Nozzle insert 212 may cause thermal spray gun apparatus 10 to create plasma discharges different from those communicated from nozzle 12 alone. Nozzle insert 212 can be inserted into spray gun nozzle 12 through exit annulus 14, to provide circumferential contact between an inner face of nozzle 12 and outer surface 216 of nozzle insert 212. Nozzle insert 212 can have an axial passage 218 extending from a fore (discharge) end to an aft end within nozzle 12. Axial passage 218 can allow a discharge within plasma spray gun body 20 (FIG. 1) to pass through nozzle insert 212 and leave spray gun apparatus 10. Axial passage 218 can be customized in each embodiment of nozzle insert 212 to adjust the velocity, temperature, and plume shape of the plasma discharge from thermal spray gun apparatus 10.

Nozzle insert 212 can be removed from nozzle 12 without disassembling thermal spray gun body 20 (FIG. 1). Nozzle insert 212 may be removable from the fore (discharge) end of thermal spray gun apparatus 10, for example, by having an outer surface 216 that engages the inner face of nozzle 12. In an embodiment, the fore end of nozzle insert 212 may have a greater cross-sectional area than the aft end of nozzle insert 212, permitting axial movement of nozzle insert 212 through nozzle 12 up to arc root attachment 13. Nozzle insert 212 can thus be removed without disassembling thermal spray gun body 20 (FIG. 1) and taking other costly or time consuming steps, such as disconnecting a water line to ports 24, 44 (FIGS. 1, 2, 4) and coolant sleeve 124 (FIGS. 1, 2, 4).

As described elsewhere herein, coolant sleeve 124 can deliver a cooling medium (e.g., water) to the exterior of nozzle 12. As plasma discharge travels through nozzle 12, its material composition rapidly increases in temperature. A cooling medium, of lower temperature than the hot surface of nozzle 12, can pass through coolant sleeve 124 to absorb heat from nozzle 12. Though coolant sleeve 124 may not travel alongside nozzle insert 212 in some embodiments, nozzle 12 can absorb heat from nozzle insert 212 while being cooled, thereby allowing heat to dissipate from nozzle insert 212 into nozzle 12, and then into coolant sleeve 124. Nozzle insert 212 of thermal spray gun apparatus 10 can also include seal element 224, interposed between nozzle insert 212 and nozzle 12. As described elsewhere herein, seal element 224 may prevent discharge from exiting thermal spray gun body 20 (FIG. 1) by passing between nozzle 12 and nozzle insert 212.

As thermal spray gun apparatus 10 operates, electrical arcs from electrode body 40 may enter electrically conductive materials within nozzle insert 212. As known in the art, electrical arcs may cross from one metal structure to another in a small area of contact between the two materials. This even may cause the two materials to weld or bond to each other in a process known as "microwelding." To reduce the risk of nozzle insert 212 being microwelded to the surface of nozzle 12, nozzle insert 212 and/or regions of nozzle 12 can be plated or coated with an electrically conductive material which features a higher melting point than the material composition of nozzle insert 212. In some embodiments, nozzle insert 212 can be coated with an exterior liner 236 composed of, e.g., a refractory metal such as tantalum or molybdenum, or other materials having a higher melting temperature than the material composition of nozzle insert 212. Coating or plating nozzle insert 212 with exterior liner 236 in this manner can inhibit microwelding which could otherwise be caused by electromigration (transfer of electrons) between nozzle insert 212 and nozzle 12.

Figure 5:
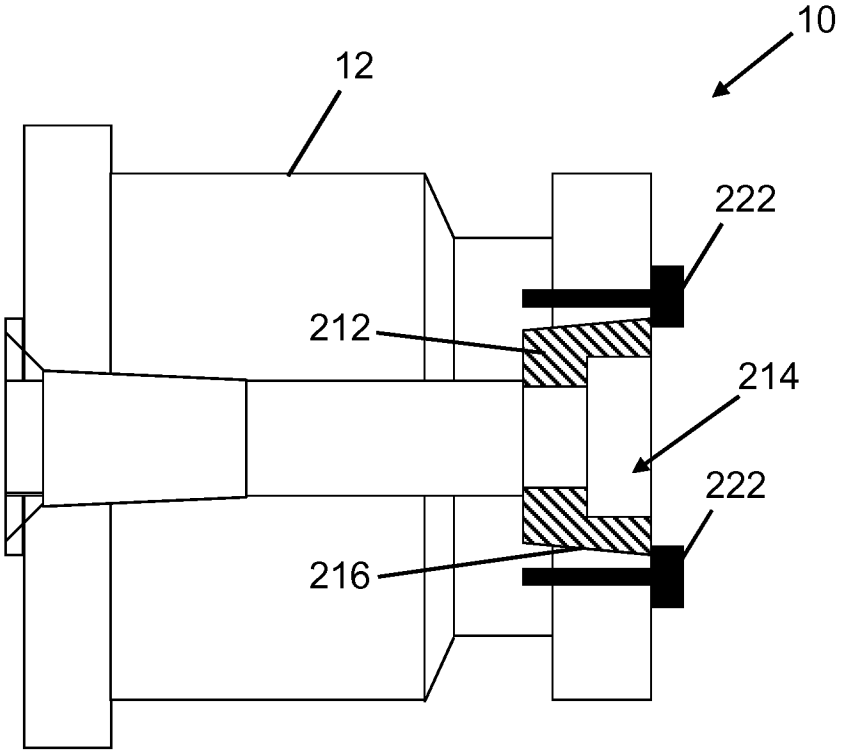
FIG. 5 shows another side view of a thermal spray gun with a removable nozzle insert according to an embodiment of the invention.

Turning to FIG. 5, another view of nozzle 12 and nozzle insert 212 is shown for the sake of clarity. As demonstrated in FIG. 5, the fore (discharge) end of nozzle 12 can have a greater cross-sectional area than the aft (body) end, allowing nozzle insert 212 to be removed from the fore end of nozzle 12. The difference in size between each end of nozzle insert 212 also creates a tapered area of contact with the surface of nozzle 12 to increase heat transfer from nozzle insert 212.

Similar to nozzle insert 212, one or more fasteners 222 can be coupled to nozzle 12 to prevent nozzle insert 212 from escaping nozzle 12. In an embodiment, each fastener 222 can be in the form of a threaded screw installed within thermal spray gun body 20 (FIG. 1), with the screw head of each fastener 222 blocking movement of nozzle insert 212 along the direction of nozzle 12. Nozzle insert 212 may be inserted into exit annulus 14 (FIG. 2) of thermal spray gun apparatus 10, and then held in place by the application of fasteners 222. To remove nozzle insert 212, each fastener 222 can be removed (e.g., by unscrewing), allowing nozzle insert 212 to pass through exit annulus 14 (FIG. 2).

While shown and described herein as a nozzle insert and thermal spray gun apparatus, it is understood that the invention further provides various alternative embodiments. For example, in one embodiment, the invention provides a thermal spray gun system (e.g., thermal spray gun system 5 (FIG. 1)) with the features described herein with respect to nozzle insert 212 and thermal spray gun apparatus 10. An embodiment of a thermal spray gun system according to the present disclosure can include, with reference to FIG. 1, an electrode body 40 within a thermal spray gun body 20, and a nozzle 12 which allows discharge 45 to pass from thermal spray gun body 20 to the exterior of thermal spray gun system 5. A removable nozzle insert such as nozzle insert 212 of FIGS. 2-5 can be located within nozzle 12. Nozzle insert 212 (FIGS. 2-5) can both adjust one or more properties of discharge 45 leaving thermal spray gun apparatus 10 and transfer heat to nozzle 12 by maintaining circumferential contact with nozzle 12. As a result, the design of coolant sleeve 124 need not be modified to accommodate nozzle insert 212. Similar to other embodiments discussed elsewhere herein, thermal spray gun system 5 can permit nozzle insert 212 to be inserted or removed directly from exit annulus 14, without thermal spray gun body 20 being disassembled.

Turning to FIGS. 6-7, two tables 300, 302 illustrating performance-related aspects of the present disclosure are shown. In particular, each table of FIGS. 6-7 illustrates the power output of thermal spray gun between a standard nozzle and a nozzle provided with a nozzle insert according to the present disclosure. Table 300 illustrates this comparison for a thermal spray gun with a non-divergent (divergent diameter IDd less than or substantially equal to arc diameter IDa) nozzle. Table 302 illustrates the same comparison for a thermal spray gun with a divergent (divergent diameter IDd greater than arc diameter IDa) nozzle. In each experiment, a thermal spray gun was provided with varying amounts of plasma gas flow (shown in standard cubic feet per hour, SPCH). As shown, each thermal spray gun can output the same amount of power whether provided with a nozzle insert or not. As suggested by the test data, the similar levels of power output for a thermal spray gun, with or without a nozzle insert, suggest that varying nozzle inserts can alter the profile of a discharge from a thermal spray gun without significantly influencing power output or other related properties produced by similarly-configured nozzles without inserts. Thus, nozzle inserts according to the present disclosure can be inserted or removed from a thermal spray gun without affecting, e.g., standoff distance, allowing the thermal spray gun to be adjusted to suit various applications. Nozzle inserts according to embodiments of the present disclosure can offer a predictable and efficient way to adjust the characteristics of discharge from a thermal spray gun.

Figure 8:
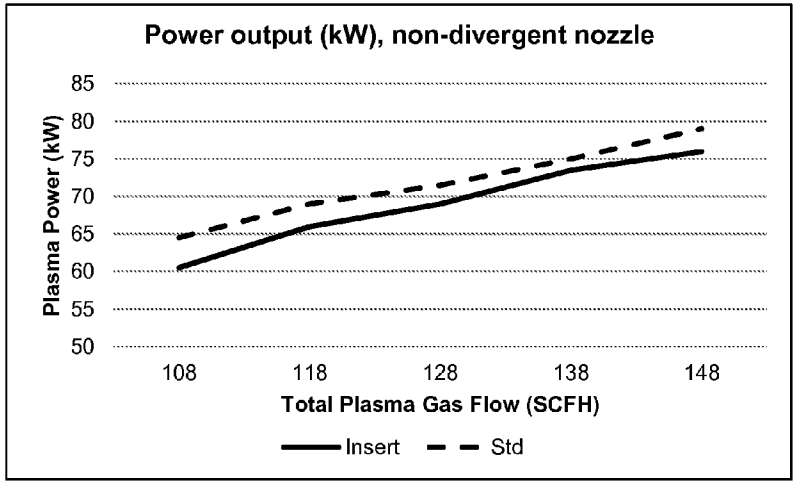
FIG. 8 provides a test plot of test data, graphically illustrating properties of an embodiment of the present disclosure.
Figure 9:
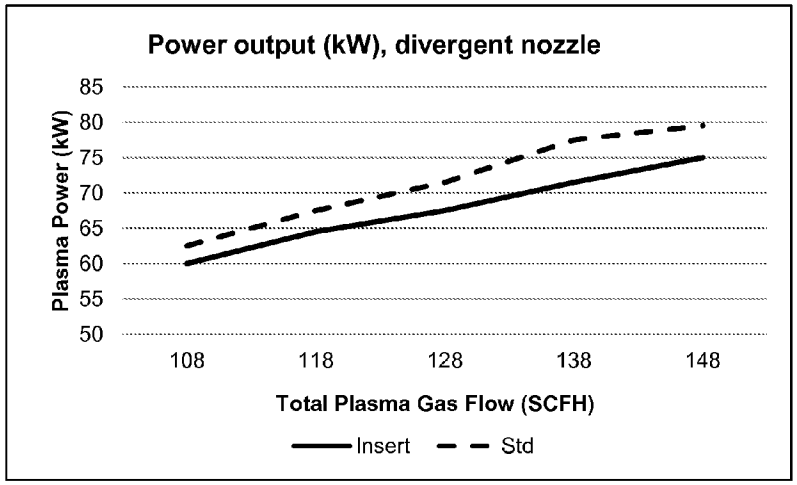
FIG. 9 provides another test plot of test data, graphically illustrating properties of an embodiment of the present disclosure.

FIGS. 8-9 shows two graphs 350, 352, illustrating electric current versus power output as measured in tables 350, 352, respectively (FIGS. 6-7). Trend lines for each sample are shown in each graph 350, 352, illustrating the statistical similarity of power output between a thermal spray gun with a nozzle insert and a thermal spray gun without a nozzle insert ("std").

The systems and devices of the present disclosure are not limited to any one particular application and can be provided in a variety of implementations. For example, the advantages described herein can be realized in any type of thermal spray gun or similar device, including plasma spray guns, cold spray, vacuum plasma spray, etc. In addition, the embodiments of the present disclosure may be applicable to applying any type of coating, such as a bondcoat, a thermal barrier coat (TBC), an abradable coat, and/or an environmental barrier coat (EBC). Various embodiments of the present disclosure can also discharge individual layers of a single coating by successively using different nozzle inserts in a single thermal spray gun apparatus. Additionally, embodiments of the present disclosure may be used with other systems in which a nozzle would normally need to be removed and replaced to change the properties of a plasma plume or other discharge.

Embodiments of the present disclosure may offer several commercial and technical advantages. For example, using various nozzle inserts according to the present disclosure may influence a performance variable of a thermal spray gun apparatus or system, including velocity, temperature, and plume shape of a discharge from the spray gun. Furthermore, a single spray gun apparatus or cell can be used to apply multiple coatings and/or layers of coatings by inserting and removing various nozzle inserts. Appling multiple coats with one nozzle, augmented with successive nozzle inserts, reduces the time and costs associated with disassembling a spray gun body. Nozzle inserts according to the present disclosure thus offer a cost-effective approach to coating workpieces with complex geometries, such as some components of steam and gas turbines. Embodiments of the present disclosure are also more efficient than other thermal spray gun modification schemes, in which the plasma discharge could be modified by adding one or more attachments downstream of a thermal spray gun nozzle.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or" comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A thermal spray gun system comprising:

an electrode housing an electrode;

a thermal spray gun body having a fore portion and an aft portion, the thermal spray gun body housing a thermal spray gun nozzle at the fore portion and coupled to the electrode body at the aft portion, the thermal spray gun nozzle having a discharge end, a body end, and a tapered interior face extending therebetween, wherein a cross-sectional area of the thermal spray gun nozzle at the discharge end is greater than a cross-sectional area of the thermal spray gun nozzle at the body end; and a removable nozzle insert in circumferential contact with the tapered interior face of the thermal spray gun nozzle and configured to transfer heat thereto, the removable nozzle insert including an axial passage configured to communicate a plasma discharge from within the thermal spray gun body;

wherein the electrode body is configured to generate an electrical arc between the electrode and the thermal spray gun body, for converting a feedstock into the plasma discharge.

2. The system of claim 1, wherein the removable nozzle insert is configured to be removed without disassembling the thermal spray gun body.

3. The system of claim 1, further comprising a removable fastener coupled to the spray gun nozzle at the body end and axially contacting the removable nozzle insert, wherein the removable fastener prevents axial movement of the removable nozzle insert relative to the thermal spray gun body.

4. The system of claim 1, wherein the removable fastener comprises a removable member inserted into an axially extending slot of the spray gun nozzle, and wherein the removable nozzle insert contacts an axially interior surface of the removable member.

5. The system of claim 1, wherein the removable nozzle insert further includes an axial exit region positioned between the axial passage and an exterior of the removable nozzle insert, wherein a cross-sectional area of the axial exit region is greater than a cross-sectional area of the axial passage.

6. The system of claim 1, wherein the aft end of the thermal spray gun body is plated with an electrically insulative material.

7. The system of claim 1, further comprising a seal element coupled to an outer surface of the thermal spray gun body.

8. The system of claim 7, wherein the seal element comprises a flange configured to prevent the plasma discharge from flowing between the outer surface of the thermal spray gun body and the tapered interior face of the thermal spray gun nozzle.

9. The system of claim 1, wherein a material composition of the thermal spray gun nozzle includes a metal included in the thermal spray gun body.

10. The system of claim 1, wherein the plasma discharge includes one of a bondcoat, a thermal barrier coat (TBC), an abradable coat, and an environmental barrier coat (EBC) from the axial passage.

11. The system of claim 1, wherein the removable nozzle insert is configured to communicate a coating, wherein the coating is different from the plasma discharge.

12. The system of claim 1, wherein a shape of the removable nozzle insert adjusts a velocity, temperature, and plume shape of the plasma discharge from the axial passage.

13. They system of claim 1, wherein the discharge end of the thermal spray gun nozzle is substantially coplanar with an axial end of the removable nozzle insert.

* * * * *